United States Patent [19]

Bowden

[11] Patent Number: 4,870,899

[45] Date of Patent: Oct. 3, 1989

[54] PREWIPE DEVICE

[76] Inventor: Robert T. Bowden, 3495 Capricorn Crescent, Mississauga, Ontario, Canada, L4T 1S5

[21] Appl. No.: 130,431

[22] Filed: Dec. 9, 1987

[51] Int. Cl.[4] ..... B41F 9/08

[52] U.S. Cl. ..... 101/155; 101/167

[58] Field of Search ..... 101/155, 156, 157, 161, 101/160, 162, 167, 168, 169, 423, 425, 363

[56] References Cited

U.S. PATENT DOCUMENTS

| | | | |
|---|---|---|---|
| 1,981,912 | 11/1939 | Fankboner | 101/169 X |
| 2,162,248 | 6/1939 | Delaplane | 101/363 X |
| 2,168,229 | 8/1939 | MacArthur | 101/157 X |
| 2,187,421 | 1/1940 | George | 101/157 |
| 3,238,870 | 3/1966 | Matkovich et al. | 101/363 X |
| 3,333,535 | 8/1967 | Behringer | 101/363 X |
| 4,066,014 | 1/1978 | van Haaften | 101/157 |
| 4,392,426 | 7/1983 | Wege | 101/363 |
| 4,497,250 | 2/1985 | Dressler | 101/425 X |
| 4,512,254 | 4/1985 | Reslow et al. | 101/157 |
| 4,537,130 | 6/1985 | Theilackér | 101/425 |

*Primary Examiner*—Edgar S. Burr
*Assistant Examiner*—James R. McDaniel
*Attorney, Agent, or Firm*—Eugene J. A. Gierczak

[57] ABSTRACT

A device for wiping ink from a cylindrical printing surface, said device being formed from a single piece of flexible material and folded to form a pair of spaced apart legs joined by a deformable folded portion, and a stiffener disposed between said legs for maintaining said legs in said spaced apart relationship, said folded portion adapted to press against and conform to a segment of said cylindrical printing surface so as to wipe ink from said printing surface as said folded portion moves over said printing surface.

15 Claims, 3 Drawing Sheets

PREWIPE DEVICE

FIELD OF THE INVENTION

This invention relates to a prewipe device for uniformally applying ink and wiping off excess ink from a printing cylinder and in particular relates to the utilization of a prewipe device in combination with a doctor blade in intaglio printing.

BACKGROUND TO THE INVENTION

Intaglio printing generally relates to the art of printing by presenting a design or figure carved or engraved below the surface of a printing plate or cylinder. Ink is then applied to the intaglio printing plate or cylinder and the excess ink is removed by any number of devices including rollers and doctor blades.

For example, U.S. Pat. No. 4,499,825 discloses an ink wiping roller which is rotably supported with its lower portion emersed in a cleansing liquid.

Another wiping arrangement is illustrated in U.S. Pat. No. 3,333,535 which shows the use of a deflector blade and a doctor blade in combination with a plate cylinder whereby ink not removed by the deflector blade is removed from the surface of the plate by the doctor blade.

Moreover, U.S. Pat. No. 4,009,657 teaches the use of a doctor blade and a prewipe blade which comprises a thin flexible blade that extends generally vertically towards the intaglio roll.

Furthermore, U.S. Pat. No. 4,676,157 discloses a wiping apparatus for an intaglio printing machine which has a first roller in rolling contact with a plate cylinder and which is driven in the same rotational direction as the plate cylinder, and a second wiping roller which is in rolling contact with the first wiping roller and which is frictionally driven in the same direction as that of the first wiping roller.

Finally, U.S. Pat. No. 1,927,056 relates to a method and mechanism for cleansing the ink surface of engraving plates and more particularly to the method of removing ink from non-printing surfaces of the plate.

Printing speed or the speed of rotation of printing cylinders of prior art printing presses is limited by a number of factors including the likelihood of generating ink voids and ink skipping due in part to inefficient wiping and application of ink to the printing cylinder by the prior art wiping devices and the creation of bubbles by turbulence which are sheared by the prior art wiping devices. The likelihood of generating ink voids and ink skipping increases particularly when lighter ink tones are required on the printed material.

Furthermore, the prior art wiping apparatus used in the printing industry present relatively complicated structures which are prone to be maintained to either remove excess ink accumulated in the vicinity of the wiping apparatus or to correct ink voids or skipping which develop on the surface of the printing cylinders due to the high rate of rotation of the printing cylinders during the printing process.

It is an object of this invention to present an improved prewipe device which is simple in construction and has improved wiping characeristics.

The broadest aspect of this invention relates to a device for wiping ink from a cylindrical printing surface, said device being formed from a single piece of flexible material and folded to form a pair of spaced apart legs joined by a deformable folded portion, and a stiffener disposed between said legs for maintaining said legs in said spaced apart relationship, said folded portion adapted to press against and conform to a segment of said cylindrical printing surface so as to wipe ink from said printing surface as said folded portion moves over said printing surface.

Another aspect of this invention relates to a device for wiping ink from a cylindrical printing surface, said device being formed from a single piece of flexible material and folded to form a pair of legs joined by a deformable folded portion, and sitffener disposed between said legs for maintaining said legs in the said spaced apart relationship so as to present a resilient core defined by said folded portion, said folded portion adapted to press against and conform to a segment of said cylindrical printing surface so as to wipe ink from said printing surface as said folded portion moves over said printing surface.

It is another aspect of this invention to provide apparatus for distributing ink onto a rotating intaglio printing cylinder for subsequent transfer to an absorbent fibrous web in contact, with said intaglio cylinder, comprising; an ink reservoir disposed below said intaglio printing cylinder, whereby ink in said ink reservoir is adapted to contact the lower portion of said rotating intaglio cylinder and to adhere onto the surface of said cylinder; a prewipe device positioned axially across the surface of said cylinder and above said reservoir, said device being formed from a single piece of flexible material and folded to form a pair of spaced apart legs joined by a deformable folded portion, and a stiffener adapted to be placed between said legs for maintaining said legs in said spaced apart relationship so as to present a resilient core defined by said folded portion, whereby said folded portion defining said resilient core is adapted to press against and conform to a segment of said printing cylinder so as to uniformly apply said ink to said surface of said intaglio cylinder and to wipe a portion of excess ink from said printing cylinder as said folded portion moves over said printing cylinder; a doctor blade positioned against said intaglio cylinder and above said prewipe device for removing substantially any excess ink on the surface of said intaglio cylinder.

Yet another aspect of this invention relates to an apparatus for distributing ink onto a rotating intaglio printing cylinder for subsequent transfer to an absorbent fibrous web in contract with said intaglio cylinder comprising: an ink reservoir disposed below said intaglio printing cylinder, whereby ink in said ink reservoir is adapted to contact the lower portion of said rotating intaglio cylinder and to adhere onto the surface of said cylinder; a prewipe device positioned axially across the surface of said cylinder, said device being formed from a single piece of felt material disposed horizontally above the axis of said intaglio cylinder, said felt material folded to form a pair of legs joined by a deformable folded portion, said legs maintained in spaced apart relationship by a stiffener disposed between said legs so as to present a resilient core defined by said folded portion, said folded portion adapted to press against and conform to a segment of said printing cylinder to uniformly apply said ink to said surface of said intaglio cylinder and to wipe a portion of said excess ink therefrom as said folded portion moves over said printing surface; a doctor blade positioned against said intaglio cylinder and above said prewipe device for removing substantially any excess ink on the surface of said intaglio cylinder.

It is another aspect of this invention to provide a method for applying ink to an intaglio cylinder for subsequent transfer to a paper web comprising the steps of: applying ink to an intaglio cylinder rotating about its axis; folding a single piece of flexible material to form a pair of spaced apart legs joined by a deformable folded portion maintained in said spaced apart relationship by a stiffener disposed between said legs; applying said folded portion against said cylinder so that said folded portion conforms to a segment of said cylinder so as to wipe said ink from said cylinder as said folded portion moves over said cylinder; removing substantially all excess ink from the surface of said intaglio cylinder by a doctor blade positioned against said intaglio cylinder and above said flexible materials; transfering ink from said intaglio cylinder to said paper web.

DRAWINGS

These and other objects and features shall now be described in relation to the following drawings.

FIG. 4 illustrates a second embodiment of the invention.

DESCRIPTION OF THE INVENTION

Like elements have been given like numbers throughout the figures.

Figure 1:
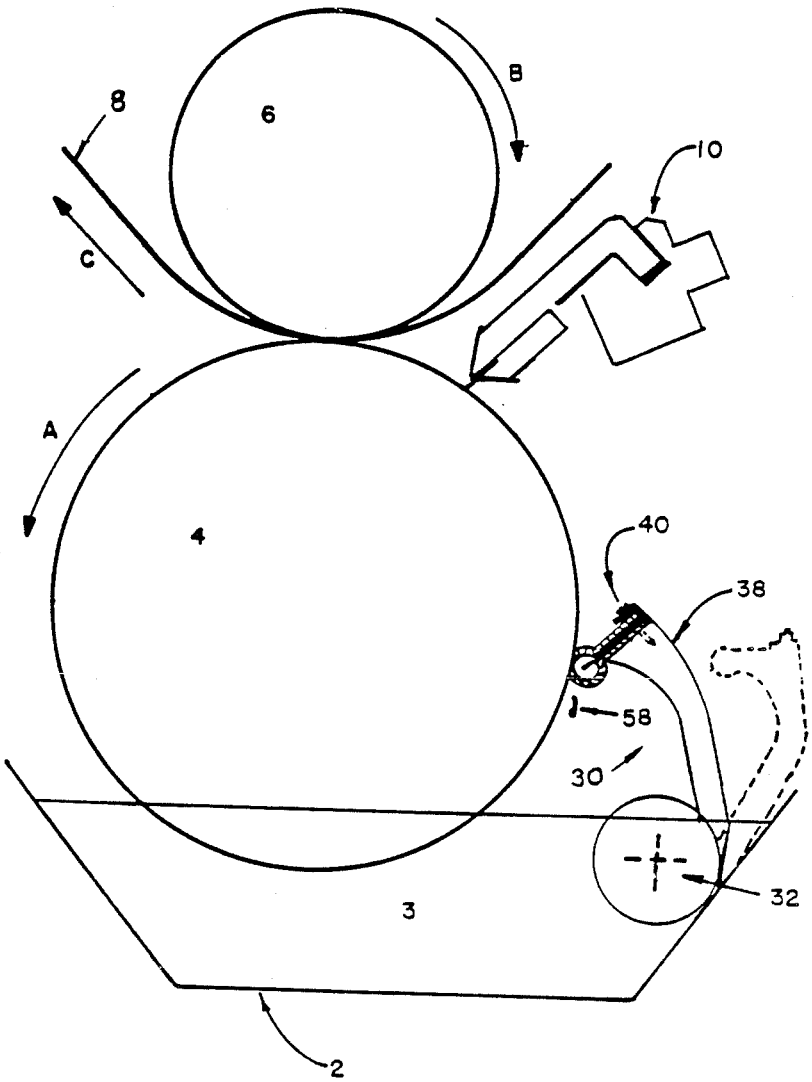
FIG. 1 is a partial side elevational view of the printing cylinders and the prewipe device.

FIG. 1 generally represents the printing process in intaglio printing which includes an ink reservoir 2, printing cylinder 4, impression roller 6, and absorbent fibrous web material such as paper 8 for printing thereon.

The printing cylinder 4 presents an impression of the image of figure to be printed onto the fibrous web 8. The impression is carved or engraved below the surface of the intaglio printing surface in a manner well known to those persons skilled in the art and accordingly shall not be described in detail herein.

The lower portion of the printing cylinder 4 is submerged in the ink 3 contained in the ink reservoir 2.

The printing cylinder 4 is adapted to be rotated in the direction illustrated by arrow A so that the circumferential surface of the printing cylinder 4 becomes coated with ink from the ink reservoir 2.

As the printing cylinder 4 continues to rotate in the counter-clockwise direction illustrated in FIG. 1, the ink 3 on the surface of the printing cylinder 4 encounters the prewipe device 30 and doctor blade 10 which scrape or wipe excess ink from the surface of the printing cylinder 4.

The impression roller 6 is adapted to rotate in the direction of arrow B in a manner so as to pinch or impress fibrous material or paper 8 against the printing cylinder 4 so as to transfer the ink from the printing cylinder 4 onto the paper 8 and produce a printed impression thereon. Furthermore the rotation of the impression roller 6 and printing cylinder 4 draws the web of paper 8 through the printing press (not shown) in the direction of arrow C.

One colour of ink is contained in ink reservoir 2 and therefore if a number of colours of ink are to be printed onto web 8 a similar arrangement of rollers and ink fountains would be presented in the printing press for each desired colour. The doctor blade 10 illustrated in FIG. 1 is adapted to scrape substantially all excess ink from the surface of the printing cylinder 4 in a manner well known to persons skilled in the art.

Figure 2:
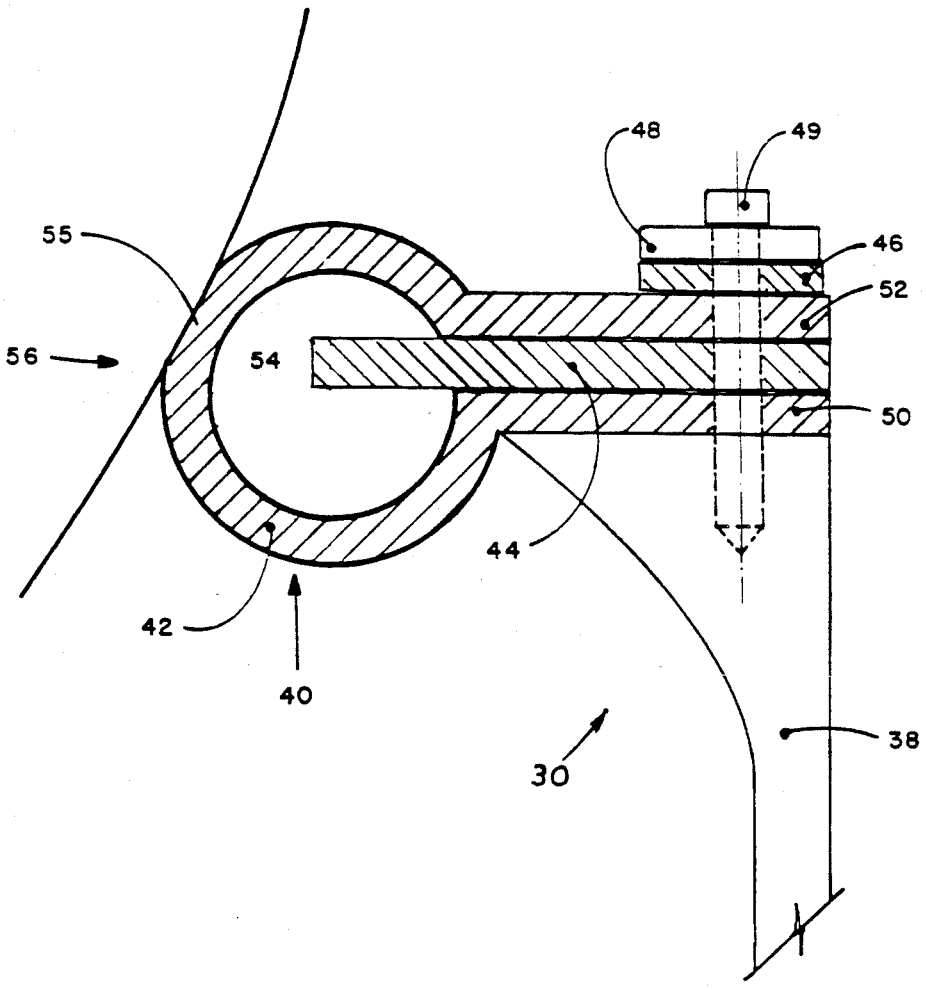
FIG. 2 is a partial cross-sectional view of the prewipe device.

It has been found that by utilizing the prewipe device 30 illustrated in FIGS. 1 and 2, problems associated with ink voids and skipping have been substantially reduced.

The prewipe device 30 presents a base portion 32 at one end thereof which generally extends along the axial length of the printing cylinder 4 and is disposed in generally spaced parallel relation thereto. The base portion 32 has a generally cylindrical cross section and is adapted to swing or rock between the two positions illustrated by the dark lines and hidden lines in FIG. 1. More particularly the cylindrical ends of base portion 32 extend into cylindrical recesses (not shown) of the frame of the printing press and are adapted to swing or rock therein.

Figure 3:
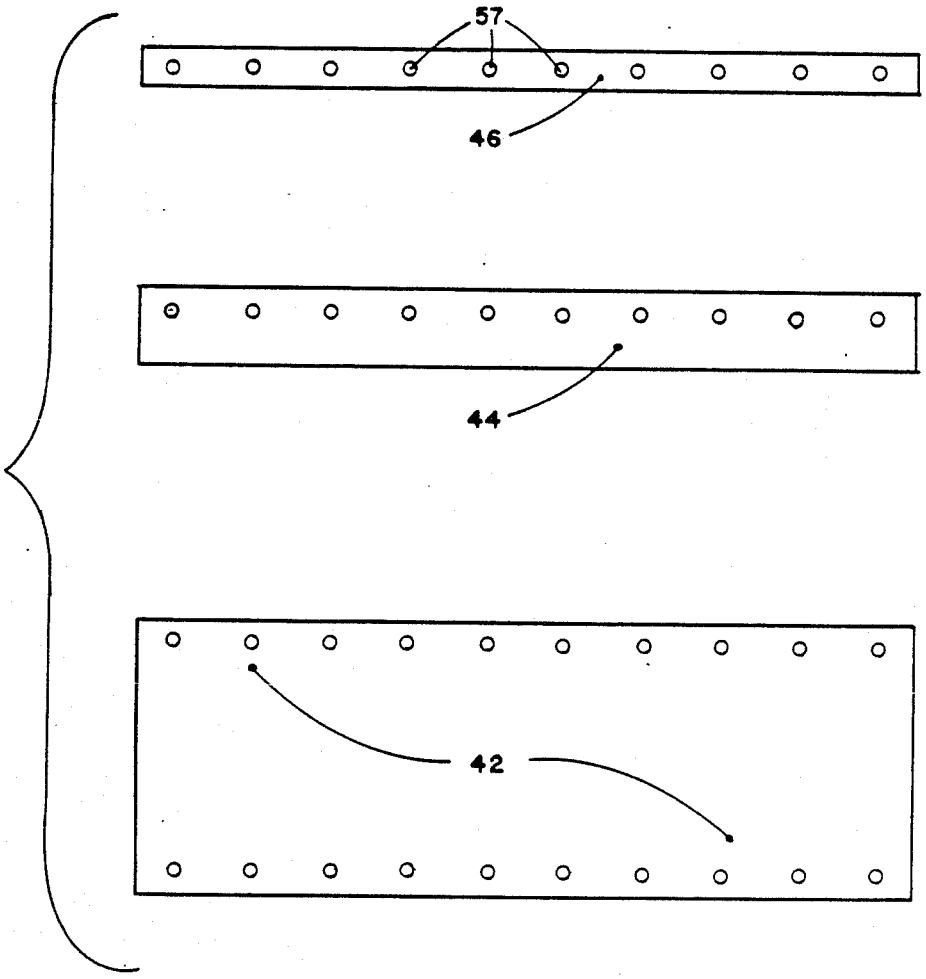
FIG. 3 is a parts drawing of the prewipe device.

The prewipe device 30 presents an arm 38 presenting a base portion 32 at one end thereof and a prewipe head 40 at the other end thereof. The prewipe head 40 is best illustrated in FIGS. 2 and 3 and comprises a flexible material 42, spacer or stiffener 44, clamp plate 46, washer 48 and fastening means such as studs 49.

More particularly, the prewipe head 40 comprises a single piece of flexible material 42 which is fibrous such as felt or the like which is folded upon itself as illustrated in FIG. 2. Furthermore a spacer or stiffener 44 is presented between the ends of the legs 50 and 52 of flexible material 42 so as to maintain the legs 50 and 52 of flexible material 42 in spaced apart relationship as well as present a space or hollow core 54 defined by the folded end 56 of the flexible material 42. Furthermore the stiffener 44 extends into the hollow core 54 to as to rigidify or stiffen the flexible material of the folded end 56.

A clamp plate 46 is presented with a series of apertures 58 which are adapted to receive the studs 49 as illustrated in FIG. 2 so as to retain the component parts of the prewipe head 40 in fixed relationship.

The prewipe device 30 includes a biasing means such as a leaf spring or the like (which is not shown as the biasing means or leaf spring is well known to those persons skilled in the art) which is adapted to press the prewipe head 40 and particularly the folded end 56 of the flexible material 42 into contact against printing cylinder 4. The biasing force is such that an operator may easily move the prewipe device 30 to the position illustrated by the hidden lines in FIG. 1.

The operation of the printing cylinder 4 and impression cylinder 6, prewipe device 30 and doctor blade 10 shall now be described. The surface of printing cylinder 4 picks up ink 3 from ink reservoir 2 as the cylinder 4 rotates in the direction of arrow A. When the surface of the printing cylinder 4 encounters prewipe device 30, the flexible material 42 will uniformally apply the ink adhereing to the surface of the printing cylinder 4 as well as wipe a portion of the excess ink 58 from the surface thereof. The excess ink 58 may either be absorbently retained by the prewipe device 40 (in the event that an absorbent felt material is used) or the excess ink (58) may fall by reason of gravity back into the ink reservoir 2.

More particularly, when the flexible material 42 comprises felt material, the felt material tends to conform to the surface of the printing cylinder 4 as best illustrated in FIG. 2 so as to present a greater wiping surface 55 which more evenly distributes the ink over the surface of printing cylinder 4 than in the case of utilizing only the prior art doctor or wiping blade which generally presents a point or line of contact between the doctor blade and the printing cylinder 4.

Furthermore the felt material 42 is resiliently yieldable as the felt material 42 is flexible or moveable so as to self-adjust for any irregularities in the roundness of the cylinder 4. This resiliency of prewipe device 30 is enhanced by the presence of the space or hollow core 54 which can accomodate relative movement of the folded end 56 of flexible material 42 either into or away from hollow core 54 so as to ensure relative contact between felt material 42 and cylinder 4 substantially at all times even in the event of irregularities in the roundness of printing cylinder 4. Although FIGS. 1 and 2 illustrate a prewipe device 30 having a hollow core 54 the space of the core 54 may be filled with a resiliently yieldable or deformable material such as felt.

FIG. 4 illustrates a second embodiment of the invention whereby the prewipe head comprises a piece of felt material 42 disposed generally horizontally above the axis of the printing cylinder and conforms to the surface of the printing cylinder 4 to uniformly apply in to the surface of the printing cylinder 4 and for wiping a portion of the excess ink therefrom.

Moreover the use of flexible material 42 such as felt reduces the wear or deterioration characteristics to the printing cylinder which are imparted by conventional doctor blades.

The utilization of the prewipe device 30 illustrated in FIGS. 1 and 4 also substantially removes any bubbles present in the ink as well as substantially reduces the formation of ink bubbles which lead to ink voids or skipping.

In one particular arrangement of intaglio printing utilizing two doctor blades it was found that the press speed was limited to 1,600 fpm before the appearance of ink voids and skipping; whereas when the lower doctor blade was replaced by the prewipe device described herein it was found that the same press speed could be increased to 2,400 fpm without the appearance of ink voids and skipping.

Furthermore a superior quality of print is exhibited by utilizing the prewipe device 40 as described herein particularly when printing lighter tones.

Also the prewipe device 30 illustrated herein exhibits longer wear characteristics than presently experienced by prior art devices which result in less frequent printing press stops for maintenance purposes.

It has been found that the use of the prewipe device 30 described herein also increases the life of the doctor blade 10 because more wiping occurs at the area of contact 55 and therefore there is less ink for the doctor blade 10 to wipe and accordingly less wiping pressure is required for the doctor blade 10 against printing cylinder 4.

While the salient features of the invention have been illustrated and described, it should be readily apparent to those skilled in the art that changes and modifications can be made in the invention presented without departing from the spirit and true scope of the invention. Accordingly, the present invention should be considered as encompassing all such changes and modifications that are within the broad scope of the invention as defined in the appended claims.

The embodiments of the invention in which an exclusive property or privilege is claimed are defined as follows:

1. A device for wiping ink from a cylindrical printing surface, said device being formed from a single piece of flexible material and folded to form a pair of spaced apart legs joined by a deformable folded portion, and stiffening means disposed between said legs for maintaining said legs in said spaced apart relationship, said folded portion adapted to press against and conform to a segment of said cylindrical printing surface so as to wipe ink from said printing surface as said folded portion moves over said printing surface.

2. A device for wiping ink from a cylindrical printing surface, said device being formed from a single piece of flexible material and folded to form a pair of spaced apart legs joined by a deformable folded portion and stiffening means disposed between said legs for maintaining said legs in said spaced apart relationship so as to present a resilient core defined by said folded portion, said folded portion adapted to press against and conform to a segment of said cylindrical printing surface so as to wipe ink from said printing surface as said folded portion moves over said printing surface.

3. A device as claimed in claim 2 wherein said flexible material comprises felt.

4. A device as claimed in claim 3 wherein said device includes an arm adapted to swing about one end thereof and said flexible material is presented at the other end of said arm.

5. A prewipe device as claimed in claim 4 including biasing means presented in the region of said one end of said arm so as to urge said flexible material in contact with said printing cylinder.

6. A prewipe device as claimed in claim 5 wherein said core is hollow.

7. Apparatus for distributing ink onto a rotating intaglio printing cylinder for subsequent transfer to an absorbent fibrous web in contact with said intaglio cylinder, comprising;

(a) an ink reservoir disposed below said intaglio printing cylinder, whereby ink in said ink reservoir is adapted to contact the lower portion of said rotating intaglio cylinder and to adhere onto the surface of said cylinder;

(b) a prewipe device positioned axially across the surface of said cylinder and above said reservoir, said device being formed from a single piece of flexible material and folded to form a pair of spaced apart legs joined be a deformable folded portion, and stiffening means adapted to be placed between said legs for maintaining said legs in said spaced apart relationship so as to present a resilient core defined by said folded portion, whereby said folded portion defining said resilient core is adapted to press against and conform to a segment of said printing cylinder so as to uniformly apply said ink to said surface of said intaglio cylinder and to wipe a portion of excess ink form said printing cylinder as said folded portion moves over said printing cylinder;

(c) a doctor blade positioned against said intaglio cylinder and above said prewipe device for removing substantially any excess ink on the surface of said intaglio cylinder.

8. Apparatus as claimed in claim 7 wherein said flexible material comprises felt.

9. Apparatus as claimed in claim 8 wherein said prewipe device includes an arm adapted to swing about one end thereof and present said flexible material having a resilient core at the other end thereof.

10. Apparatus as claimed in claim 9 wherein said fibrous web comprises a web of paper.

11. Apparatus as claimed in claim 9 wherein said core is hollow.

12. Apparatus for distributing ink onto a rotating intaglio printing cylinder for subsequent transfer to an absorbent fibrous web in contract with said intaglio cylinder comprising:

(a) an ink reservoir disposed below said intaglio printing cylinder, whereby ink in said ink reservoir is adapted to contact the lower portion of said rotating intaglio cylinder and to adhere onto the surface of said cylinder;

(b) a prewipe device positioned axially across the surface of said cylinder, said device being formed from a single piece of felt material disposed horizontally generally below the axis of said intaglio cylinder, said felt material folded to form a pair of legs joined by a deformable folded portion, said legs maintained in spaced apart relationship by stiffening means disposed between said legs so as to present a resilient core defined by said folded portion, said folded portion adapted to press against and conform to a segment of said printing cylinder to uniformly apply said ink to said surface of said intaglio cylinder and to wipe a portion of said excess ink therefrom as said folded portion moves over said printing surface;

(c) a doctor blade positioned against said intaglio cylinder and above said prewipe device for removing substantially any excess ink on the surface of said intaglio cylinder.

13. In a method for applying ink to an intaglio cylinder for subsequent transfer to a paper web comprising the steps of:

(a) applying ink to an intaglio cylinder rotating about its axis;

(b) folding a single piece of flexible material to form a pair of spaced apart legs joined by a deformable folded portion maintained in said spaced apart relationship by stiffening means disposed between said legs;

(c) applying said folded portion against said cylinder so that said folded portion conforms to a segment of said cylinder so as to wipe said ink from said cylinder as said folded portion moves over said cylinder;

(d) removing substantially all excess ink from the surface of said intaglio cylinder by a doctor blade positioned against said intaglio cylinder and above said flexible materials;

(e) transfering ink from said intaglio cylinder to said paper web.

14. A device as claimed in claim 6 wherein said stiffening means extends into said hollow core.

15. Apparatus as claimed in claim 11 wherein said stiffening means extends into said resilient core.

* * * * *